US008894308B2

(12) United States Patent
Geuther et al.

(10) Patent No.: US 8,894,308 B2
(45) Date of Patent: Nov. 25, 2014

(54) WIPER FOR DUAL APPLICATOR

(75) Inventors: Manuela Geuther, Ansbach (DE); Werner Fischer, Burk (DE)

(73) Assignee: Geka GmbH, Bechhofen (DE)

( * ) Notice: Subject to any disclaimer, the term of this patent is extended or adjusted under 35 U.S.C. 154(b) by 273 days.

(21) Appl. No.: 13/463,047

(22) Filed: May 3, 2012

(65) Prior Publication Data

US 2013/0004227 A1 Jan. 3, 2013

(30) Foreign Application Priority Data

May 3, 2011 (DE) ..... 20 2011 100 182 U

(51) Int. Cl.
*A46B 11/00* (2006.01)
*A45D 40/26* (2006.01)

(52) U.S. Cl.
CPC ..... *A45D 40/267* (2013.01)
USPC ..... 401/122; 401/121

(58) Field of Classification Search
USPC ..... 401/121, 122, 4, 126, 128, 129, 130
See application file for complete search history.

(56) References Cited

U.S. PATENT DOCUMENTS

| | | | | |
|---|---|---|---|---|
| 4,458,701 | A * | 7/1984 | Holland | 132/218 |
| 5,176,156 | A | 1/1993 | Ashtary et al. | |
| 6,024,507 | A * | 2/2000 | Joulia | 401/4 |
| 6,325,071 | B1 | 12/2001 | Butcher | |
| 7,997,820 | B2 * | 8/2011 | Bouix et al. | 401/35 |
| 8,523,473 | B2 * | 9/2013 | Kim | 401/126 |

FOREIGN PATENT DOCUMENTS

WO 2004077987 A1 9/2004

* cited by examiner

*Primary Examiner* — David Walczak

(57) ABSTRACT

A wiper for wiping off a pincer-like cosmetics applicator, the wiper comprising a substantially sleeve-shaped wiper body for mounting in a container neck. The passage for the cosmetics applicator formed inside the wiper body is divided, at least in some areas, by a dividing wall into two passage portions extending next to one another, each of which is able to accommodate a part of the cosmetics applicator.

13 Claims, 4 Drawing Sheets

WIPER FOR DUAL APPLICATOR

FIELD OF THE INVENTION

The invention relates to a wiper.

BACKGROUND OF THE INVENTION

Wipers of this type are known in various embodiments. They serve for wiping cosmetics applicators that are dipped into a cosmetics container in order to pick up the required amount of the cosmetic to be applied, and which are then withdrawn from the cosmetics applicator in order to apply this cosmetic. In such a process for charging the applicator, it has to be ensured that the applicator is not excessively charged with the cosmetic mass, and the applicator stem with as little as possible.

In the case of such cosmetics units, wipers are therefore usually provided in the neck of the cosmetic bottles. The stem of an applicator, and later also the applicator element or brush attached thereto, wipes along the wiper when the applicator is withdrawn from the storage container. In the process, excess cosmetic is removed from the applicator and, in particular, also from its stem.

Most of the usual applicators have a single stem or shaft with a single cosmetic brush attached thereto.

In the field of application of liquid and pasty cosmetic media and in particular in the area of the application of mascara masses, there is a need from time to time to use applicators with which particular effects can be achieved, e.g. a so-called curling, i.e. a special curving of the eyelashes wetted with mascara. In order to be able to realize such effects, so-called "pincer applicators", as described for example in the U.S. Pat. No. 5,176,156, are sometimes used. They consist of two parallel stems that respectively carry one applicator element of their own at their end facing the container side. At their other ends, these two stems are interconnected through a spring member, so that they can actually be used like pincers. It is easy to comprehend that the eyelashes in such an applicator are grasped with the two applicator elements and can thus be wetted effectively with mascara mass. In the process, they are at the same time provided with the desired curvature or the desired curl.

Besides the early pincer applicators, which in part seemed rather awkward, quite workable applicators have been developed in recent times. Roughly, they correspond to a conventional applicator, the only difference being that the stem is divided into two parts along the longitudinal axis. These two parts are connected to each other and can be compressed in a pincer-like manner. At their ends, they carry one applicator element each.

Wiping these modern pincer applicators with wipers has already been tried. Even in the case of such pincer applicators, the conventional wipers work relatively well to the extent that they are actually able to wipe off the outer circumference of the stem rather well, and also the outer areas of the two application elements that rest against each other. However, the excess of mascara mass that is located in the gap by which the two stems rest against each other poses a problem. Furthermore, the excess of liquid or pasty mass that is located in the area at which the two applicators or brushes rest against each other also causes problems.

In view of this, it is the object of the invention to provide a wiper with which it is possible to wipe pincer applicators almost as cleanly as in the case of the known single-stem applicators.

SUMMARY OF THE INVENTION

The wiper according to the invention comprises a substantially sleeve-shaped wiper body. This can be inserted into a preferably circular container neck. The wiper according to the invention is characterized in that the passage for the cosmetics applicator formed inside the wiper body is divided, at least in some areas, by a dividing wall into two passage portions extending next to one another. Of those, each is able to accommodate a part of the cosmetics applicator, namely a stem together with the applicator attached thereto.

Given such a design, it is not difficult to provide a peripheral wiper lip for each of the two applicator stems, i.e. a wiper lip which wipes off the respective stem and the application element attached thereto over the entire circumferential surface. Using such a wiper, cosmetics units with pincer applicators can now be built whose pincer applicators are respectively charged with a well-defined amount of cosmetics or mascara mass upon being dipped into the cosmetics supply and withdrawn therefrom, and which, moreover, can be handled very cleanly because no unwiped "blind angles" remain on the pincer applicator, from which excess mass can drop towards the user unexpectedly.

Preferably, the wipers according to the invention are equipped in such a manner that their dividing wall extends over at least ¼, better at least ½ of the length of the wiper in the direction of the imaginary longitudinal axis of the respective wiper. A certain extension in space of the dividing wall is a precondition for a good wiping action. Though it is conceivable in principle to achieve a certain wiping action already by providing, instead of a dividing wall, only a type of "dividing beam" which divides the passage on the inside of the wiper body only very locally into two passage halves, however, such a "minimal solution" exhibits only a much reduced wiping action. Therefore, while this embodiment is not the most preferred embodiment, it still falls within the scope of the invention.

Within the context of a preferred embodiment, it is provided that the wiper comprises a collar for supporting the wiper on a cosmetics container against forces acting in the direction of its longitudinal axis L. In this special embodiment, the dividing wall is supposed to end on the side of the wiper pointing inside the container, underneath the collar. A wiper thus configured can be mounted easily, and in particular is able to easily latch to the container neck, without having to subject the dividing wall to an excessive elastic or even elastoplastic deformation. As a rule, this goes easily on the dividing wall.

Within the context of a preferred embodiment, it is provided that the wiper comprises a wiper lip in the form of a reduced-diameter area on its end pointing inside the container and/or a wiper lip in the form of a peripheral, strip-like depression extending transverse to the push-through direction of the applicator at its end pointing inside the container. Such a design ensures that the wiper contacts the stem or brush to be wiped off only very locally and therefore improves the wiping action.

Particularly preferably, it is ensured that the dividing wall comprises, at the level at which the wiper body forms said wiper lip, a thickened portion which substantially extends transverse to the push-through direction of the applicator, preferably in the form of a strip which is raised over the adjacent surfaces of the dividing wall and which extends over the entire width of the dividing wall. The "width" of a dividing wall is in this case understood to be the larger extension of the partition wall perpendicular to the longitudinal axis L. The wiping action is considerably improved if the dividing wall does not rest against the leg to be wiped off over its entire surface, but locally, which is achieved by said dividing strip.

For the same reason, it is provided, within the context of a preferred embodiment, that the wall thickness of the dividing wall decreases from the end of the wiper pointing inside the container in the direction towards its end pointing out of the container.

Within the context of another preferred embodiment, it is provided that the wiper is configured and dimensioned in such a way, and also comprises at least one latching element by which it can be fixed in the direction of the longitudinal axis on the cosmetics container in such a way, that it is able to follow the rotary movement of the cosmetics applicator when the cosmetics unit is screwed open and shut, and that it is nevertheless retained securely on the cosmetics container when the cosmetics applicator is withdrawn. A wiper configured in this manner is therefore made in such a way that it is retained on the container neck by positive fit, but so loosely that it is able to co-rotate in the container neck. In this case, it is a particular challenge to ensure that the wiper seals securely against the container neck once a pressing action in the direction of the longitudinal axis L is forced upon it by the screw-on closure or the applicator attached thereto. In order to ensure an appropriate tightness in this case, it may make sense to provide a pronounced collar on the wiper, under which, for example, a relatively soft seal is found which seals the gap between the collar and the container neck when the wiper is pressed against the container neck in the direction of the longitudinal axis. More particularly, the collar may seal an outside of the wiper against the cosmetics container as well as seal an inside of the wiper against a cosmetics container cap, with the collar configured in such a way that the collar is pressed on by the cosmetics container cap once the cosmetics container cap reaches its full locking position, in such a way that the collar seals both against the cosmetics container as well as against the cosmetics container cap.

An alternative consideration is to provide so-called conical sealing surfaces, i.e. a type of conical contact element on the container neck, against which a conical mating surface rests in the area of the collar of the wiper, and which seals reliably as soon as the wiper is pressed against the bottle's neck by the cap or the applicator attached thereto. Provided that the angle of said cone is selected in such a way that no self-locking action occurs, it would be ensured at the same time that the wiper regains its movability in the circumferential direction once it is no longer pressed against the container neck by a pressing action in the direction of the longitudinal axis.

For the above-mentioned reasons, another embodiment is preferred in which the collar consists of a rubber-elastic material, or in which the collar bears a rubber-elastic coating at least in the area of its sealing surfaces, or in which a loose rubber-elastic seal is provided which forms a part of the wiper and is plugged onto the wiper in such a way that, if the wiper is mounted as intended, the loose rubber-elastic seal lies between the collar and the cosmetics container against which the collar strikes. A wiper configured in this manner using two substances, with its local soft-elastic covering, also seals particularly well against the container neck once it is pressed against it in the direction of the longitudinal axis.

Within the context of a particularly preferred embodiment, it is provided that the wiper body comprises a first part on which a second part is retained rotatably. In this case, the first part is configured in such a way that it can be fixed on a cosmetics container as intended. The second part of the wiper comprises the actual wiper lip and said dividing wall which divides the passage offered to the cosmetics applicator by the second part of the wiper into two passage portions extending next to one another.

Such a two-part design of the wiper has the big advantage that the pincer applicator provided for cooperation with the wiper can be rotated despite the fact that its two stems are plugged into different passage portions of the wiper. This is due to the fact that the lower part of the wiper, which is rotatably mounted on the first fixed part, co-rotates. This offers the great advantage that the cosmetics unit can be of a simpler construction on the whole. No separate closure cap and a pincer applicator separate from it are required any longer. Rather, the pincer applicator can be integrated into the closure cap, and can be rotated together with the closure cap once it has been threaded into the wiper, in order to screw the cosmetics container shut.

In this case, it is particularly preferred to latch the first part of the wiper body and the second part of the wiper body together in a rotatable manner.

BRIEF DESCRIPTION OF THE DRAWINGS

Further mechanisms of action, optional improvements and optional embodiments of the wiper according to the invention become apparent from the following description of two exemplary embodiments, with reference to the Figures.

DETAILED DESCRIPTION OF THE PREFERRED EMBODIMENTS

Figure 1:
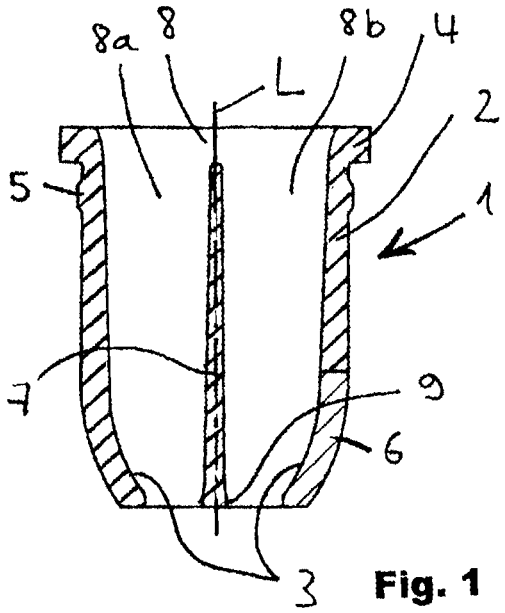
FIG. 1 shows a section along the longitudinal axis through a first exemplary embodiment of the wiper according to the invention.
Figure 5:
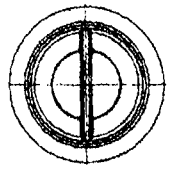
FIG. 5 shows a view from above onto the wiper according to FIG. 1.
Figure 2:
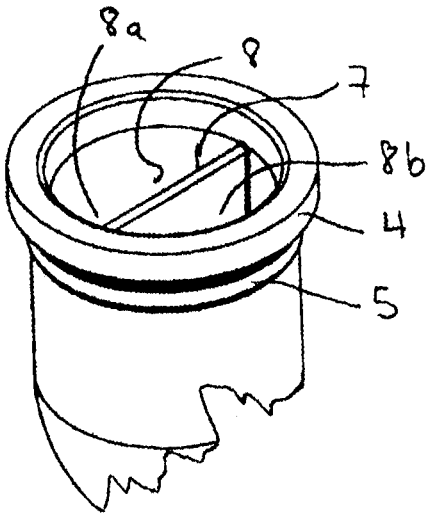
FIG. 2 shows a partial perspective lateral view from above of the wiper according to FIG. 1.
Figure 4:
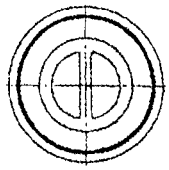
FIG. 4 shows a view from below of the wiper shown by FIG. 1.
Figure 3:
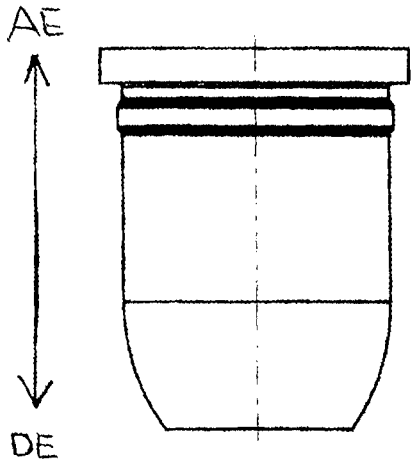
FIG. 3 shows a lateral view of the wiper according to FIG. 1.

FIGS. 1 and 2 show a first exemplary embodiment of the wiper 1 according to the invention.

As can be seen, the wiper 1 comprises a substantially sleeve-shaped wiper body 2, i.e. a wiper body 2 that substantially has the shape of a "tube", which as a rule has a circular cross section. The inside of the wiper 1, which seen in the direction of the longitudinal axis L is completely hollow, forms a passage 8 through which a cosmetics applicator 14 can be inserted into a cosmetics container 10 from the outside and which the cosmetics applicator 14 passes again when it is withdrawn from the cosmetics container 10, see FIGS. 6 and 7.

The wiper body 2 is thin-walled; its wall thickness is preferably at least 0.25 mm, better at least 0.4 mm, and maximally 1.5 mm. The wiper 1 generally consists of a plastic or an elastomer or even a rubber-elastic material.

The wiper body 2 can be configured to consist of a single component, i.e. consist of only a single material. In that case, it is particularly simple to produce, which is of great importance in the case of a disposable part. For more sophisticated applications, the wiper body 2 can be given a multi-component configuration and consist, for example, of a basic element consisting of a hard plastic to which an area consisting of a softer or even rubber-elastic material is injection-molded which forms the collar 4 and/or the wiper lip 3.

The wiper body 2 preferably tapers towards the end thereof inside the container and thus forms a wiper lip 3.

The wiper 1 is provided for mounting in a preferably circular container neck and is configured accordingly. On its side facing away from the inside of the container, it bears a collar 4 with which it is supported against the bottle's neck or the upper end of the container in which it is mounted. It is thus ensured that the wiper 1 is not pressed into the cosmetics container 10 by the forces produced when the applicator 14 is pushed in. Moreover, it also seals the bottle.

On the side of the collar 4 pointing inside the container, the wiper body 2 is provided with a latching element, which in this case is configured in the form of a latching bead 5. The latter latches into a corresponding latching groove 21, 22 of the container neck if the wiper 1 is mounted as intended. In this exemplary embodiment, the latching bead 5 and the external diameter of the wiper body 2 underneath the collar 4 are configured in such a way that the wiper 1 is non-rotatably retained on the bottle's neck after having been mounted as intended.

The wiper lip 3 is given the required elasticity either by the material of the wiper 1 alone, and/or also by the configuration in the area of the wiper lip 3, so that it is able to also resiliently abut against the stem to be wiped off and the applicator 14 to be wiped off. For example, a suitable configuration may be to provide the outer wall of the wiper body 2 with slits 6 in the area of the wiper lip 3. In that case, such slits 6 divide the wiper body 2 into a row of individual segments whose elasticity is far higher than that of the continuous wiper body 2. The slits 6 can lie in a plane which intersects the longitudinal axis L of the wiper 1 or in a plane that extends skewed to the longitudinal axis L. In many cases it is particularly advantageous if the slits 6 are not configured in a rectilinear manner, but lie on a helical line, for example.

As can be seen rather well in FIG. 1, the passage 8 of the wiper 1 is divided by a dividing wall 7 into two passage portions 8*a*, 8*b* extending next to one another. The dividing wall 7 is preferably planar and preferably at least mainly or, most frequently even substantially, smooth. Generally, it is formed by a continuous, non-perforated wall and is injection-molded integrally together with the rest of the wiper body 2 in a single process step. In that case, it preferably consists of the same material as the rest of the wiper body 2. However, there may also be cases in which it is expedient to configure the dividing wall 7 with openings or as a kind of screen. In such cases, production takes place in such a way that the correspondingly holed or perforated dividing wall 7 is produced in a first step and then, when the actual wiper body 2 is injection-molded, is overmolded together with it in the area of the outer walls of the wiper body 2.

Preferably, the dividing wall 7 tapers from the inward end DE of the wiper 1 towards the outer end AE of the wiper 1. It is expedient that the dividing wall 7 has its greatest strength at the level of the wiper lip 3, because there, it should abut the area of the applicator 14 to be wiped off by it in the most intimate manner.

In this case, it is particularly advantageous if the thickness of the dividing wall 7 is about 10-30% less than the wall thickness of the wiper body 2. This is readily possible because the dividing wall 7 is generally connected to the wiper body along the entire length of its transition into the wiper body 2, and is thereby held "folded open" by it.

In the present exemplary embodiment, the dividing wall 7 extends in a plane lying on the central line L. The passage 8 is thus divided into passage portions 8*a*, 8*b* of the same size.

In the present exemplary embodiment, the dividing wall 7 extends over at least 6/7 of the length of the wiper 1 in the direction of the longitudinal axis L. This is particularly advantageous. Generally, it can be said, the length of the dividing wall 7 is at least ¼ of the length of the wiper 1 in the direction of the longitudinal axis L, better still ½ of the length of the wiper 1 in this direction.

As can be seen rather well in FIG. 1, the dividing wall 7, at the level of the wiper lip 3 or of the inward end DE of the wiper lip 3, has a certain thickened portion 9. This thickened portion 9 is preferably configured, on each side of the dividing wall 7, as a kind of strip that respectively extends in the direction perpendicular to the longitudinal axis L from one outer wall of the wiper body 2 to the other outer wall of the wiper body 2.

Figure 6:
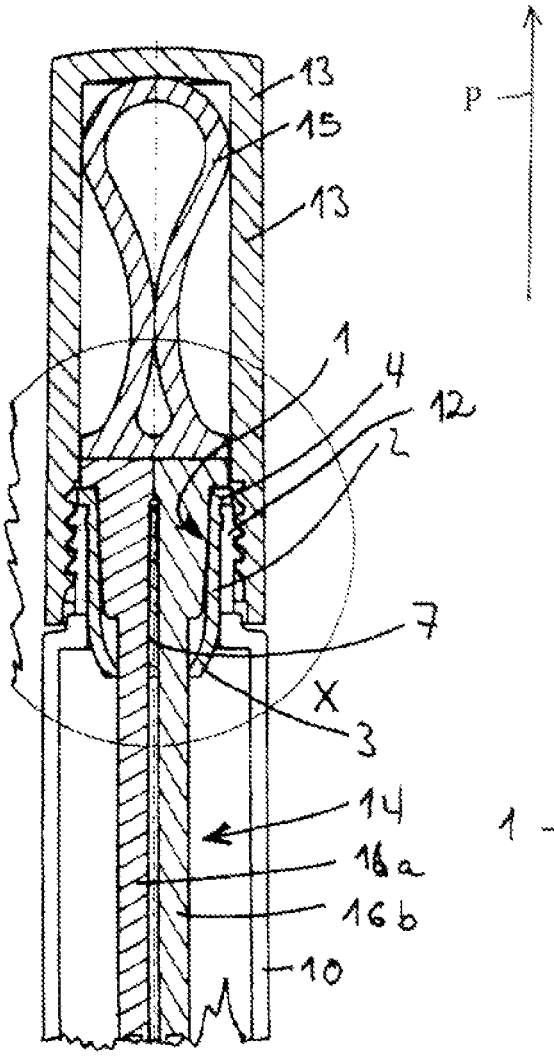
FIG. 6 shows a mounting example for the first exemplary embodiment of the applicator according to the invention.
Figure 7:
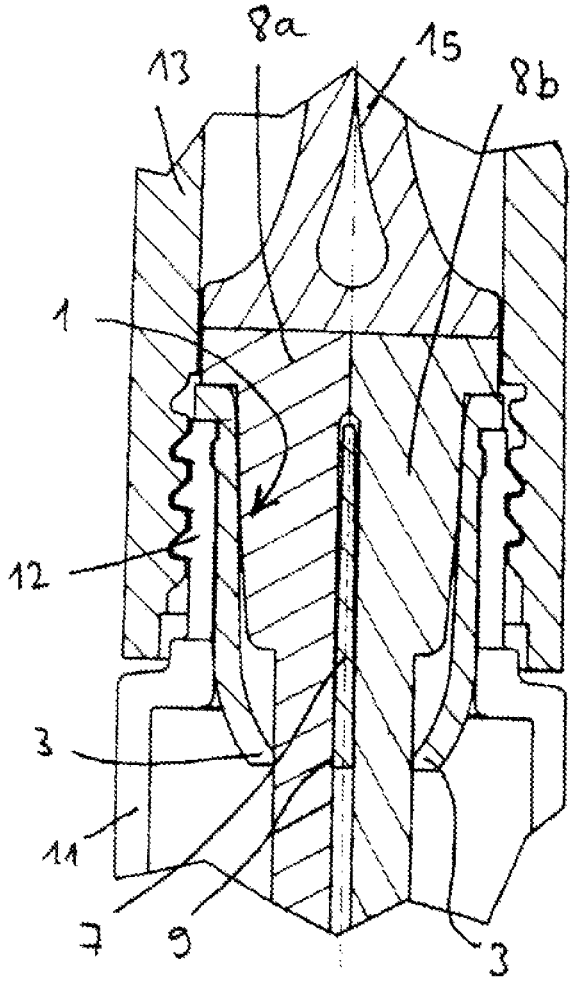
FIG. 7 shows an enlarged section from FIG. 6.

FIGS. 6 and 7 show how the wiper according to the invention 1 is expediently used and what effect it has in the process.

FIG. 6 shows a cosmetics container 10, which in this case is configured as a mascara bottle. The cosmetics container 10 has a container portion 11 and a neck portion 12, which in turn is provided with an outer thread. According to the invention, the wiper 1 is plugged into the neck portion 12. It is latched to the neck portion 12 by the latching bead 5. At the same time, it is supported in the direction of the longitudinal axis L against the neck portion 12 by its collar 4. In this way, the wiper 1 is fixed in the direction of the longitudinal axis towards the top and towards the bottom. The wiper 1 is substantially fixed with regard to a rotary movement in the circumferential direction by the friction forces between it and the neck portion 12.

A cap 13, which keeps a cosmetics applicator 14 in place by pressing on the topmost part of its handle 15, is screwed onto the neck portion 12.

In this case, the cosmetics applicator 14 is configured as a so-called "pincer applicator", i.e. its handle 15 constitutes a resilient connection between two stems 16*a* and 16*b*. One applicator element, respectively, is attached to the lower end of the two stems 16*a*, 16*b*, which in this case is not shown anymore due to the discontinuing line, for example in the form of an injection-molded mascara brush, which is covered on its outer circumference with bristles.

As can be seen, the first stem 16*a* of the applicator 14 reaches through the first passage portion 8*a* of the wiper 1. In the same way, the stem 16*b* of the applicator 14 reaches through the second passage portion 8*b*. The dividing wall 7 is nestled between the two stems 16*a* and 16*b*. According to FIG. 7, the situation in the area of the wiper lip 3 of the wiper 1 is that the wiper lip 3, which is formed by the inwardly retracted area of the wiper body 2, abuts all around the stems 16*a* and 16*b*, which together form a body with a substantially circular cross section. At the same level, the dividing wall 7, with its thickened portion 9, abuts the inner sides of the two stems 16*a* and 16*b*, each of which form a plane contact surface in this area. For the sake of completeness, it must be remarked that the two stems 16*a* and 16*b* of course do not mandatorily have to form a plane contact surface, but may also form an undulating surface, for example. If that is the case, then the dividing wall 7 of course has to adapt accordingly and have a corresponding profile.

It is easily clear that the stems 16*a* and 16*b* are wiped off all around once the cosmetics applicator 14 is withdrawn from the cosmetics container 10 upwards in the direction of the arrow P in order to apply a cosmetic. The application elements attached to the ends of the stems 16*a* and 16*b* are preferably also wiped off in the same way once they pass the first passage portion 8*a* or the second passage portion 8*b*.

Because the wiper 1 is fixed to the cosmetics container 10, the reinsertion of the cosmetics applicator 14 has to take place in such a way that one first looks for the correct position of the cosmetics applicator 14 that is suitable for inserting.

Then, the cosmetics applicator 14 is pushed through the wiper 1 and inserted into the cosmetics container 10. Once it has reached its final position, the cap 13, which holds together the entire assembly, can be screwed on again. Due to the fact that the cosmetics applicator 14 and the cap 13 of the cosmetics unit are configured as two unconnected parts in this case, the cosmetics applicator 14 does not have to be rotated together with the cap when the cosmetics unit is closed. Therefore, it gets along with the wiper 1 which is immovably fixed in the bottle's neck.

FIGS. 8 to 13 show a second exemplary embodiment of the invention. The statements above regarding the first exemplary embodiment of the invention apply to this second exemplary embodiment in the same way, with the exception of those differences that result from the two-part design of the wiper, which is described in more detail below.

Figure 8:
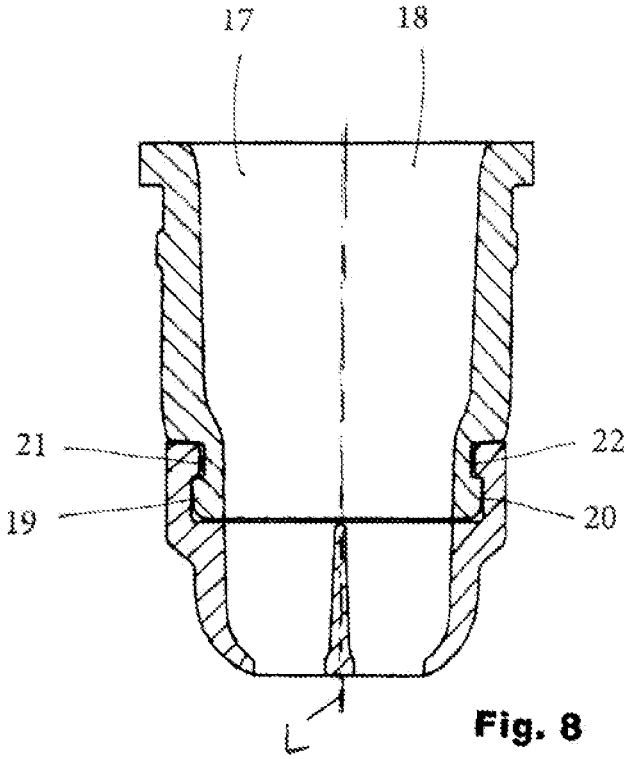
FIG. 8 shows a section of a second exemplary embodiment of a wiper according to the invention along the longitudinal axis L.
Figure 11:
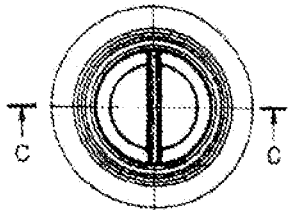
FIG. 11 shows a top view onto the wiper according to FIG. 8.
Figure 9:
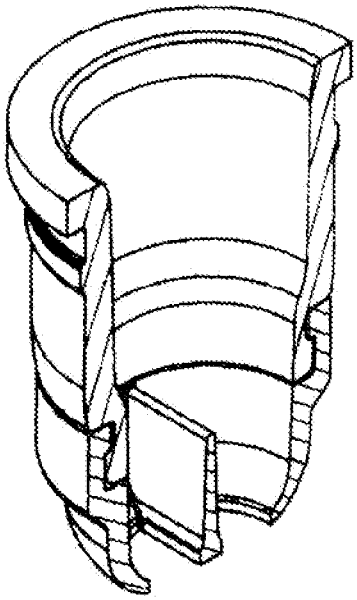
FIG. 9 shows a perspective section of the second exemplary embodiment according to FIG. 8.
Figure 10:
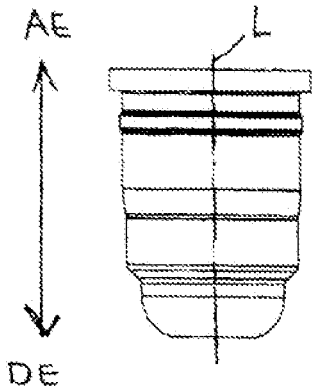
FIG. 10 shows a lateral view of the wiper according to FIG. 8.
Figure 12:
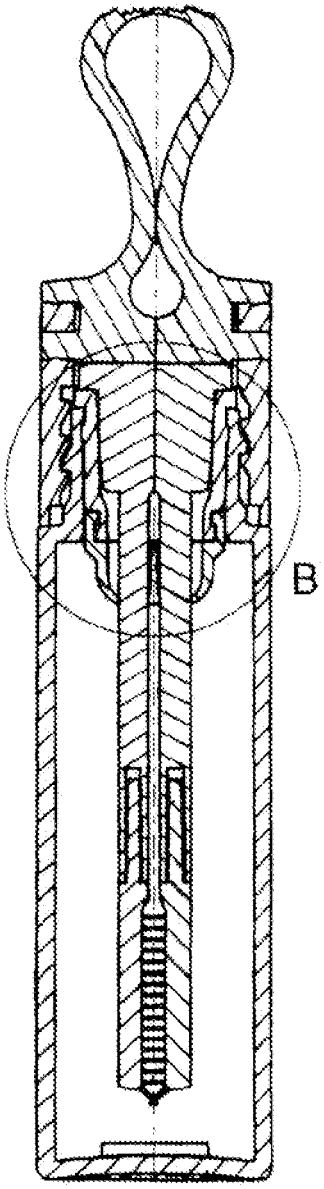
FIG. 12 shows a mounting example for the second exemplary embodiment of the applicator according to the invention.
Figure 13:
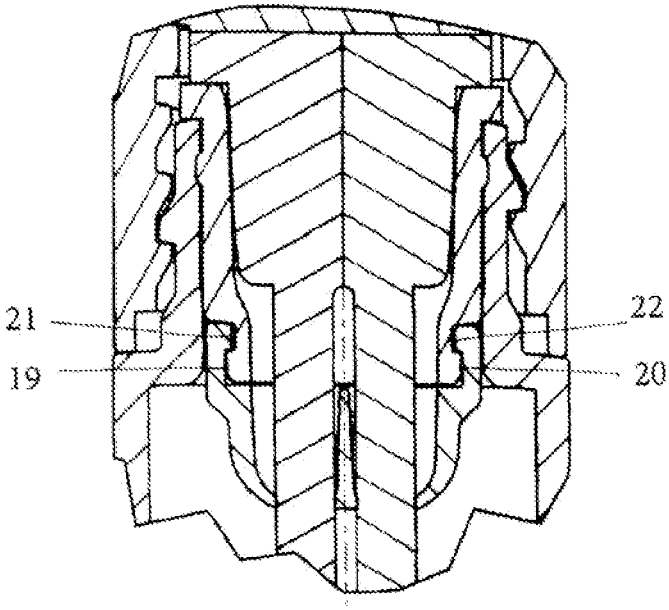
FIG. 13 shows an enlarged section from FIG. 12.

As can best be seen in FIG. 8, the wiper 1 in this exemplary embodiment is divided into a first wiper part 17 and a second wiper part 18, which together form a wiper body 2. The two wiper parts 17, 18 are latched to each other in a positive fit and, when new, can be easily rotated relative to one another. The positive-fit elements 19, 20, 21, and 22 are designed or provided with a tolerance in such a way that the second wiper part 18, however, can be rotated not only when it is new, but remains rotatable over the entire intended life of the wiper, which is designed as a disposable part. For this purpose, each of the wiper parts 17, 18 is configured with a latching lug 19, 20 and at the same time with a latching groove 21, 22, so that each wiper part 17, 18 is latched with its own latching lug to the other wiper part.

The first wiper part 17 is non-rotatably fixed to the neck portion 12 of the cosmetics container 10 if it has been mounted as intended. The first wiper part 17 is not provided with a dividing wall 7, but forms a single uniform passage 8 through which both stems of the pincer-like applicator 14 extend. Only the second, movable wiper part 18 is equipped with a dividing wall 7. The dividing wall 7 extends preferably at least substantially over the entire length of the movable second wiper part 18 in the direction of the longitudinal axis L. At least, however, the dividing wall 7 extends over at least ½ of the length of the second wiper part 18 in the direction of the longitudinal axis L. The thickened portion 9 that the dividing wall 7 of the second wiper part 18 comprises in the areas in which the inwardly retracted part of the wiper body 2 forms the wiper lip 3 can be discerned rather well in FIG. 9.

Due to the fact that the second wiper part 18 is rotatably fixed to the fixed first wiper part 17, it becomes possible to unite the cosmetics applicator 14 with the cap 13, which is preferably designed as a screw-on closure, as is also otherwise known, for example, from many mascara applicators.

The invention claimed is:

1. A wiper for wiping off a pincer-like cosmetics applicator, the wiper comprising:

a substantially sleeve-shaped wiper body for mounting in a circular container neck; and a passage for a pincer-like cosmetics applicator formed inside the wiper body, wherein the passage is divided, at least in some areas, by a dividing wall into two passage portions extending next to one another, each of which is able to accommodate a part of the cosmetics applicator;

wherein the wiper body comprises a first part rotatably retained on a second part, wherein the first part is configured in such a way that the first part is adapted to be fixed on a cosmetics container and the second part comprises a wiper lip as well as said dividing wall, which divides the passage offered to the cosmetics applicator by the second part into the two passage portions extending next to one another.

2. The wiper according to claim 1, wherein the dividing wall extends over at least ¼, a length of the wiper in a direction of an imaginary longitudinal axis of the wiper.

3. The wiper according to claim 1, further comprising a collar for supporting the wiper on the cosmetics container against forces acting in a direction of a longitudinal axis, wherein the dividing wall ends on a side of the wiper pointing inside the container, underneath the collar.

4. The wiper according to claim 3, further comprising a wiper lip having a reduced-diameter area on its end pointing inside the container.

5. The wiper according to claim 3, further comprising a wiper lip having a peripheral, strip-like thickened portion extending transverse to a push-through direction of the applicator at its end pointing inside the container.

6. The wiper according to claim 4, wherein the dividing wall comprises, at a level at which the wiper body forms the wiper lip, a thickened portion which substantially extends transverse to the push-through direction of the applicator, and the thickened portion comprises a strip which is raised over adjacent surfaces of the dividing wall and which extends over an entire width of the dividing wall.

7. The wiper according to claim 1, wherein the dividing wall —apart from any thickened portion—is planar and, over its entire length, lies on an imaginary central axis of the wiper.

8. The wiper according to claim 1, wherein a wall thickness of the dividing wall decreases from an end of the wiper pointing inside the cosmetics container in a direction towards an end pointing out of the container.

9. The wiper according to claim 1, wherein the wiper is dimensioned in such a way, and comprises at least one latching bead, by which the wiper can be fixed in a direction of a longitudinal axis on the cosmetics container in such a way that the wiper is able to follow a rotary movement of the cosmetics applicator when a cosmetics unit including the cosmetics container is screwed open and shut, and remains on the cosmetics container when the cosmetics applicator is withdrawn.

10. The wiper according to claim 9, wherein the wiper can follow the rotary movement of the cosmetics applicator when the cosmetics unit is screwed open and shut and remains on the cosmetics container when the cosmetics applicator is withdrawn, wherein the wiper comprises a collar for sealing an outside of the wiper against the cosmetics container and for sealing an inside of the wiper against a cosmetics container cap, and the collar is configured in such a way that the collar is pressed on by the cosmetics container cap, once the cosmetics container cap reaches its full locking position, in such a way that the collar seals both against the cosmetics container as well as against the cosmetics container cap.

11. The wiper according to claim 10, wherein the collar comprises a rubber-elastic material, or the collar comprises a rubber-elastic coating at least in an area of one of its sealing surfaces, or a loose rubber-elastic seal is provided which forms a part of the wiper and is plugged onto the wiper in such a way that, when the wiper is mounted, the loose rubber-elastic seal lies between the collar and the cosmetics container against which the collar strikes.

12. The wiper according to claim 1, wherein the first part of the wiper body and the second part of the wiper body are rotatably latched to each other.

13. The wiper according to claim 12, wherein a latching joint between the first part and the second part comprises a latching lug and a latching groove on each of the first and second parts.

* * * * *